US009586723B1

(12) United States Patent
Touw

(10) Patent No.: US 9,586,723 B1
(45) Date of Patent: Mar. 7, 2017

(54) GAS CAN

(71) Applicant: Harry G. Touw, Bowmanville (CA)

(72) Inventor: Harry G. Touw, Bowmanville (CA)

( * ) Notice: Subject to any disclaimer, the term of this patent is extended or adjusted under 35 U.S.C. 154(b) by 66 days.

(21) Appl. No.: 14/747,497

(22) Filed: Jun. 23, 2015

(51) Int. Cl.

| | |
|---|---|
| ***B65D 25/28*** | (2006.01) |
| ***B65D 25/48*** | (2006.01) |
| ***B65D 25/20*** | (2006.01) |
| ***B65D 85/00*** | (2006.01) |
| ***B65D 25/30*** | (2006.01) |

(52) U.S. Cl.
CPC ..... *B65D 25/28* (2013.01); *B65D 25/205* (2013.01); *B65D 25/2897* (2013.01); *B65D 25/30* (2013.01); *B65D 25/48* (2013.01); *B65D 85/70* (2013.01); *B65D 25/2826* (2013.01)

(58) Field of Classification Search
CPC .. B65D 25/205; B65D 25/28; B65D 25/2826; B65D 25/2897; B65D 25/30; B65D 25/48; B65D 85/70
USPC ..... 220/752, 755, 770, 771, 772; 222/465.1, 222/466
See application file for complete search history.

(56) References Cited

U.S. PATENT DOCUMENTS 1,331,409 A * 2/1920 Barnett ..... B65D 25/32 220/771
3,746,200 A * 7/1973 Flider ..... B65D 25/385 215/10
3,927,797 A 12/1975 Flider
4,351,454 A * 9/1982 Maynard, Jr. ..... B65D 1/12 206/506
4,588,111 A * 5/1986 Hestehave ..... B67D 7/005 220/86.1
4,811,865 A * 3/1989 Mueller, Jr. ..... B65D 47/068 215/246
4,881,650 A * 11/1989 Bartz ..... F16N 31/004 141/98
4,892,207 A * 1/1990 Cullis ..... B65D 23/104 215/10
4,923,098 A * 5/1990 Schoonover ..... B65D 1/18 215/380
4,928,860 A * 5/1990 Knight ..... B65D 1/18 215/370
4,969,571 A * 11/1990 Bartz ..... B65D 1/20 215/382
D326,050 S * 5/1992 Stockstill ..... D23/211.2
5,226,574 A 7/1993 Durinzi, Jr.
(Continued)

FOREIGN PATENT DOCUMENTS

| | | |
|---|---|---|
| CA | 2664553 | 4/2008 |
| WO | WO9429180 | 12/1994 |

*Primary Examiner* — Nicholas J Weiss
(74) *Attorney, Agent, or Firm* — Kyle A. Fletcher, Esq.

(57) ABSTRACT

The gas can includes a contoured handle that is molded out of a base portion of the gas can so as to aid in manipulating the gas can. The gas can includes a level window along a side of the gas can to indicate the volume of the contents of the gas can. The gas can also includes a base portion that provides for a glove storage compartment. The glove storage compartment extends across a width of the gas can. A plug is provided to seal the glove storage compartment in order to access and retrieve a glove there from. The gas can includes a spout on a first top surface. The gas can includes a molded handle on a second top surface. The molded handle includes a clip hole as well as a bungi cord hole. The sides of the gas can may include a reflective decal.

9 Claims, 5 Drawing Sheets

(56) References Cited

U.S. PATENT DOCUMENTS

| | | | | | |
|---|---|---|---|---|---|
| D340,640 | S | * | 10/1993 | Ferguson | D23/211.1 |
| 5,400,928 | A | * | 3/1995 | Resnick | B65D 25/2894 206/446 |
| 5,447,110 | A | * | 9/1995 | Brown | B65D 1/0292 141/114 |
| D418,759 | S | * | 1/2000 | Holmstrom | D9/528 |
| 6,029,858 | A | | 2/2000 | Srokose | |
| 6,237,792 | B1 | * | 5/2001 | Skolnicki | B65D 23/10 215/365 |
| 6,832,705 | B2 | * | 12/2004 | Hollander | B65D 23/10 222/465.1 |
| 6,983,868 | B1 | * | 1/2006 | Harris | B65D 25/42 141/392 |
| D516,434 | S | * | 3/2006 | McGuire | D9/524 |
| D528,423 | S | * | 9/2006 | Glover | D9/524 |
| 7,360,980 | B2 | * | 4/2008 | Brewer | B60R 11/00 410/100 |
| 7,487,883 | B2 | | 2/2009 | Waters | |
| 7,513,394 | B2 | * | 4/2009 | Bone | B65D 25/44 222/465.1 |
| D608,855 | S | | 1/2010 | Hatch | |
| 7,686,168 | B1 | * | 3/2010 | Smiley | A47J 47/18 206/542 |
| D670,355 | S | | 11/2012 | Zimmerman | |
| 8,701,929 | B1 | | 4/2014 | Long | |
| 9,199,770 | B2 | * | 12/2015 | Rose | B65D 1/0223 |
| D760,869 | S | * | 7/2016 | Sanders | D23/211.1 |
| 2010/0155434 | A1 | | 6/2010 | Bradford | |
| 2014/0299615 | A1 | | 10/2014 | Van Gelder | |

* cited by examiner

GAS CAN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of gas cans, more specifically, a gas can that includes, among other things, a contoured handle along a bottom, rear edge to aid in manipulating the gas can when dispensing contents there from.

SUMMARY OF THE INVENTION

The gas can includes a contoured handle that is molded out of a base portion of the gas can so as to aid in manipulating the gas can. The gas can includes a level window along a side of the gas can to indicate the volume of the contents of the gas can. The gas can also includes a base portion that provides for a glove storage compartment. The glove storage compartment extends across a width of the gas can. The contoured handle extends from a rear surface of the gas can around the glove storage compartment, and over to a bottom surface of the base storage compartment in order to access and retrieve a glove there from. The gas can includes a spout on a first top surface. The gas can includes a molded handle on a second top surface. The molded handle includes a clip hole as well as a bungi cord hole. The sides of the gas can may include a reflective decal.

It is an object of the invention to provide a gas can that includes a contoured handle that is located at a bottom and rear portion of the gas can to aid in the manipulation of the gas can when dispensing fluid there from.

A further object of the invention is to provide a handhold on a molded handle that is opposite of the contoured handle to aid in providing an enhanced gripping action when dispensing the fluid from the gas can.

Another object of the invention is to provide a base portion that has an increased footprint when compared to the body of the gas can in order to provide increased stability.

These together with additional objects, features and advantages of the gas can will be readily apparent to those of ordinary skill in the art upon reading the following detailed description of presently preferred, but nonetheless illustrative, embodiments of the gas can when taken in conjunction with the accompanying drawings.

In this respect, before explaining the current embodiments of the gas can in detail, it is to be understood that the gas can is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the gas can.

It is therefore important that the claims be regarded as including such equivalent construction insofar as they do not depart from the spirit and scope of the gas can. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
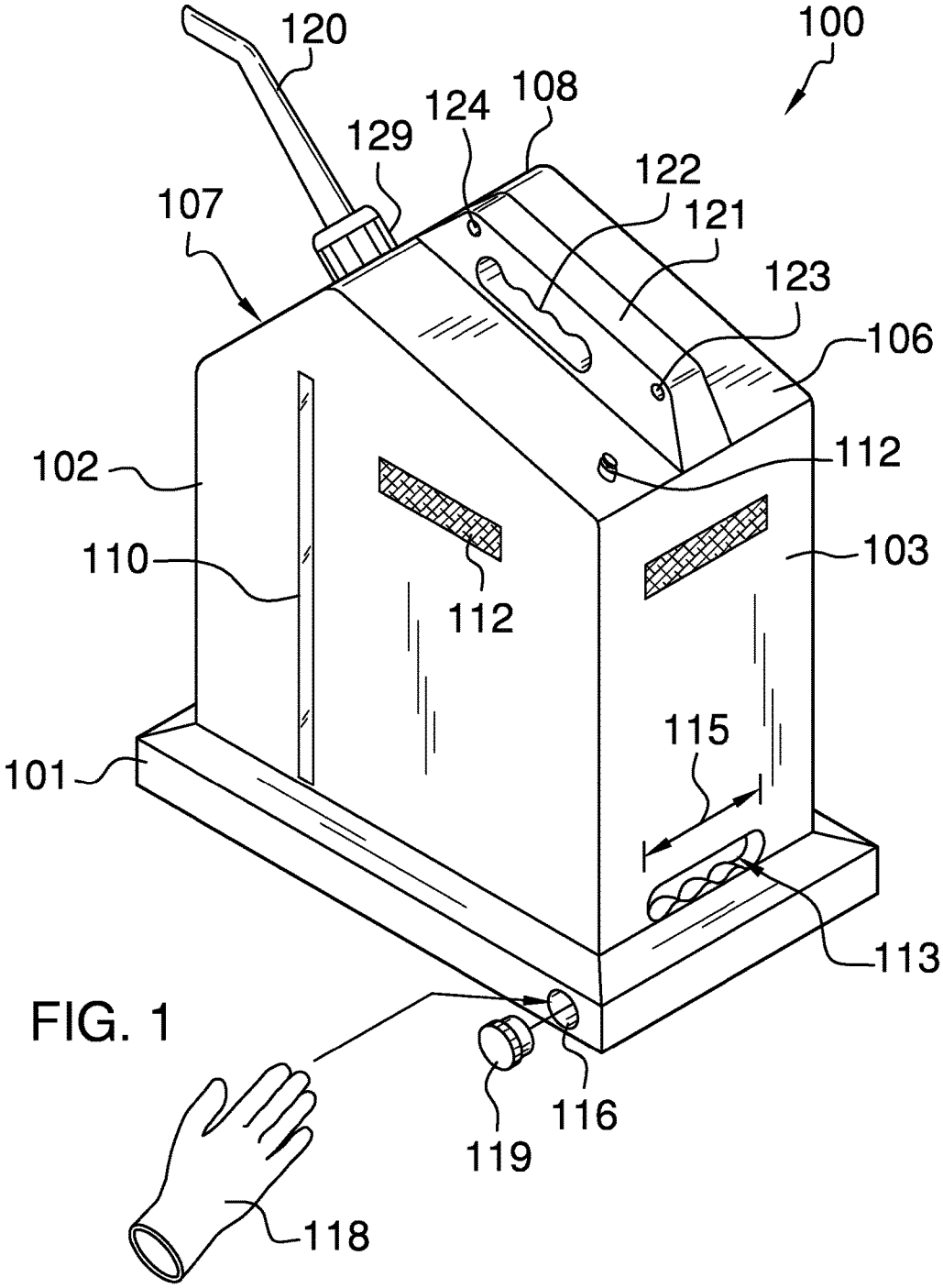
FIG. 1 is a perspective view of an embodiment of the disclosure.
Figure 2:
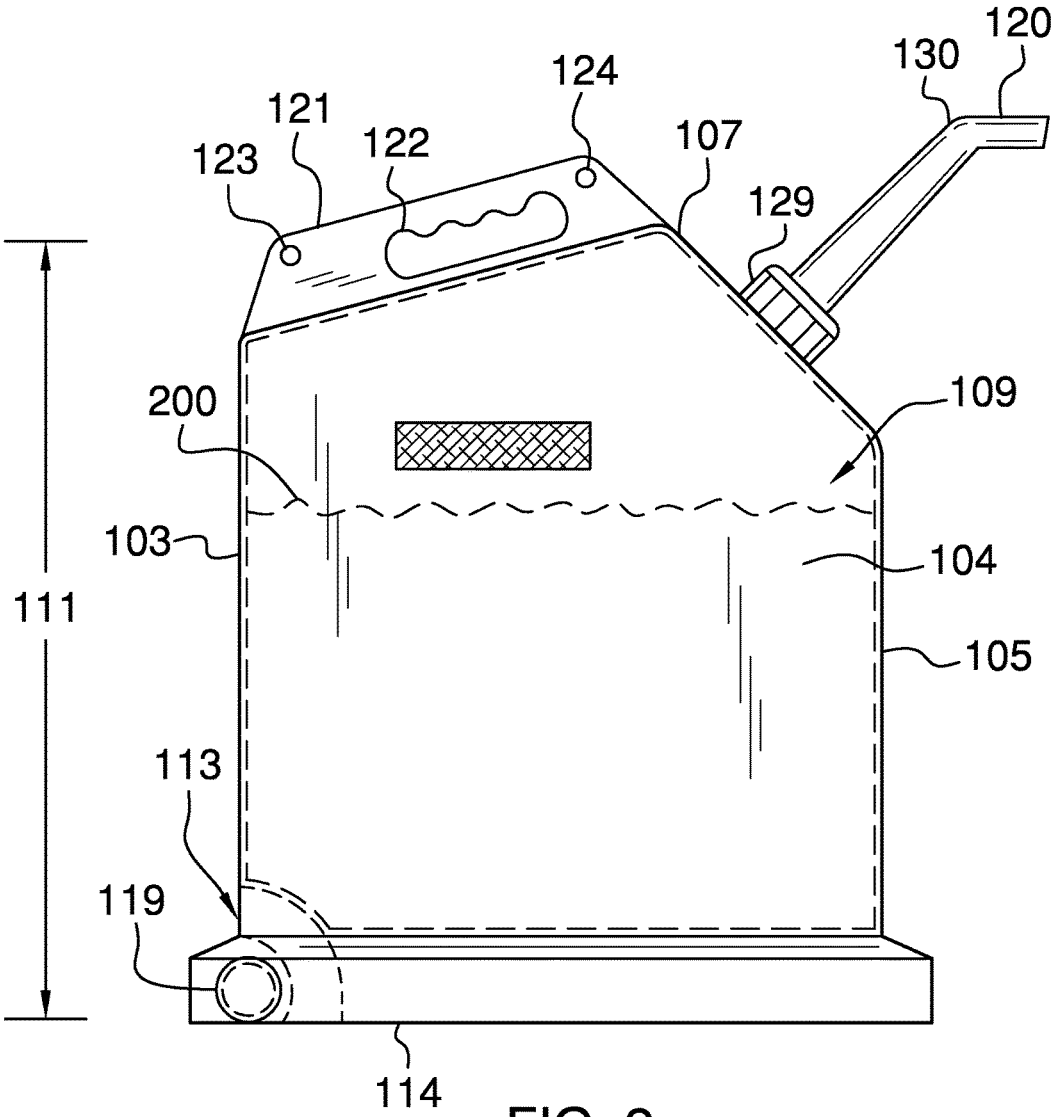
FIG. 2 is a side view of an embodiment of the disclosure.
Figure 3:
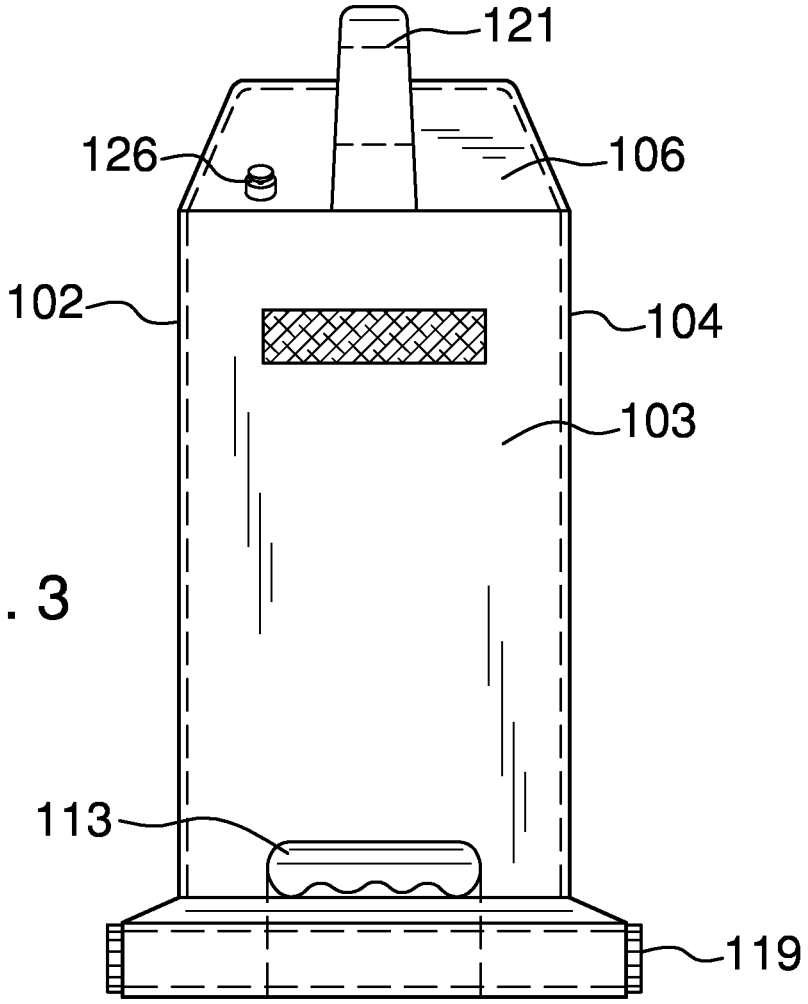
FIG. 3 is a rear view of an embodiment of the disclosure.
Figure 4:
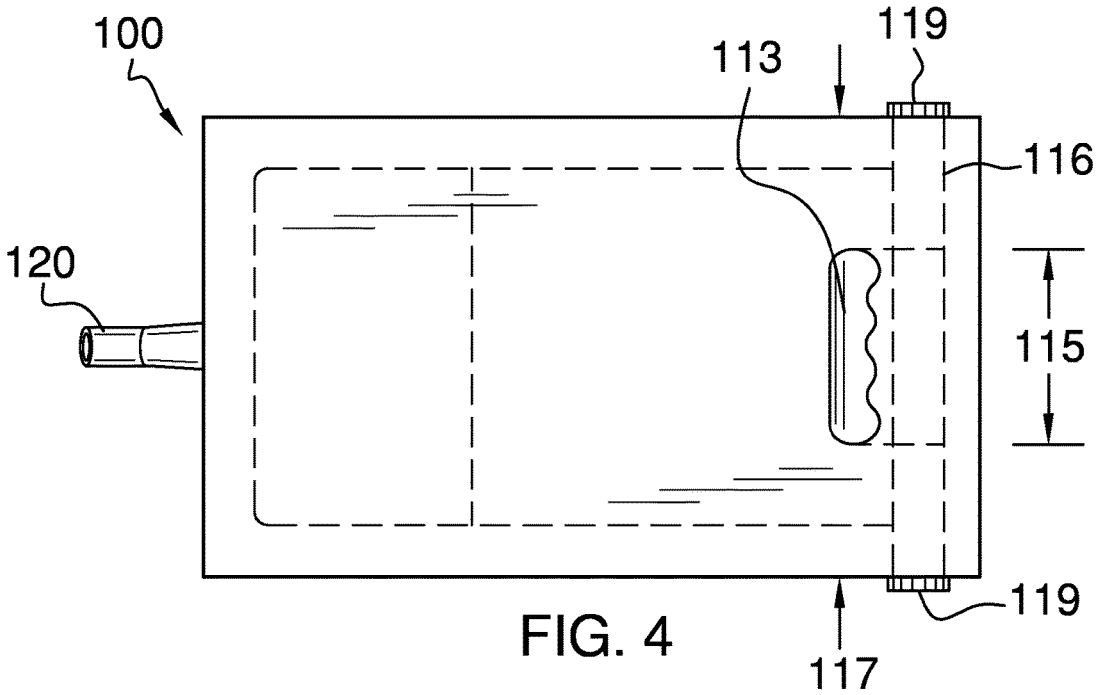
FIG. 4 is a bottom of an embodiment of the disclosure in use.
Figure 5:
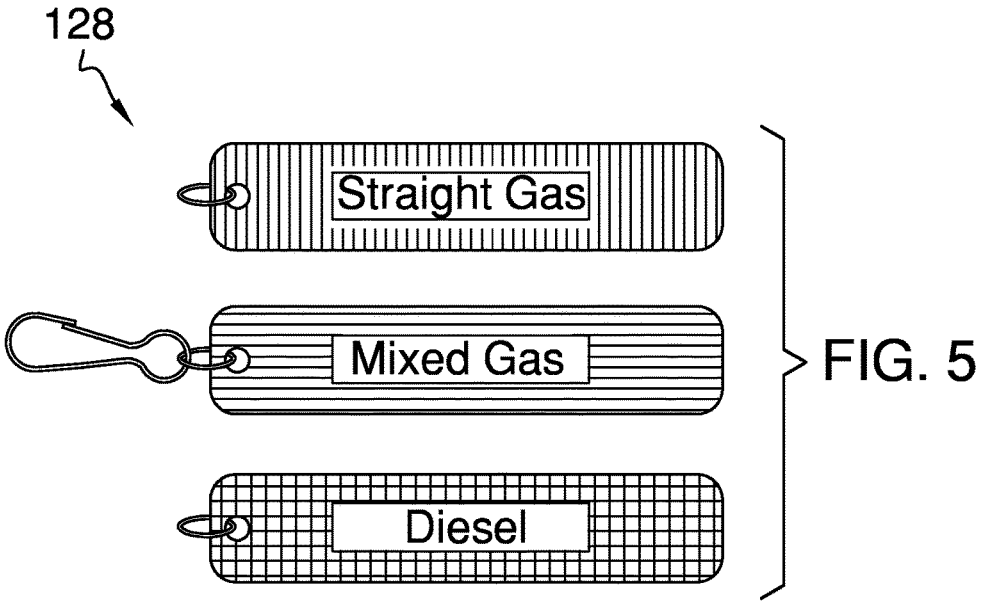
FIG. 5 is a view of some tags for use with an embodiment of the disclosure.
Figure 6:
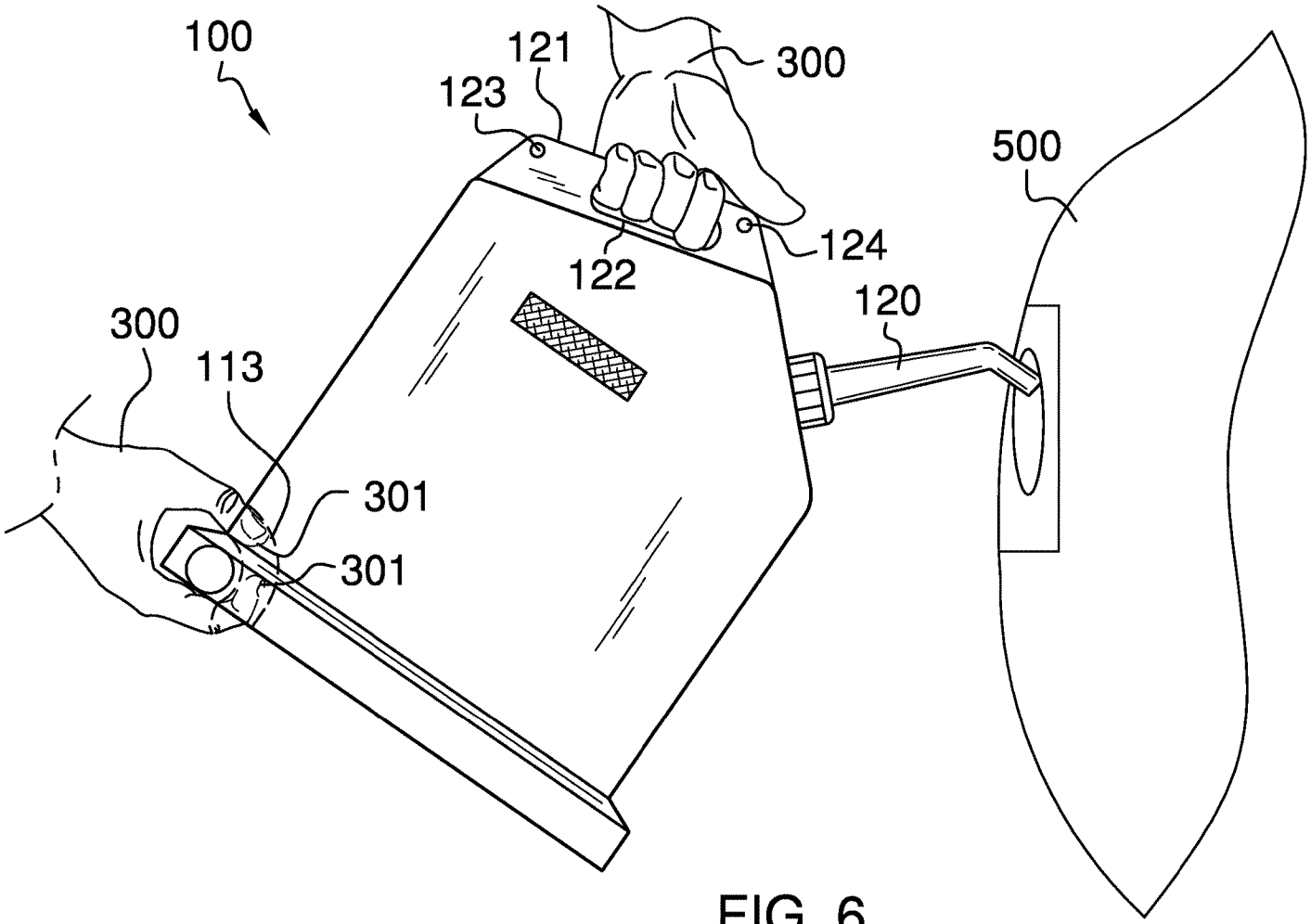
FIG. 6 is a side view of an embodiment of the disclosure in use.

As best illustrated in FIGS. 1 through 6, the gas can 100 (hereinafter invention) generally comprises a base portion 101 from which a first side 102, a second side 103, a third side 104, and a fourth side 105. The first side 102 is opposite the third side 104. The second side 103 is opposite the fourth side 104.

A fifth top side 106 is adjacent the first side, the second side 103, and the third side 104. A sixth top side 107 is adjacent the third side 104, the fourth side 105, and the first side 102. The sixth top side 107 abuts the fifth top side 106 at a top edge 108. The fifth top side 106 and the sixth top side 107 are obtusely oriented with respect to one another, and define the top portion of the invention 100.

The base portion 101, the first side 102, the second side 103, the third side 104, the fourth side 105, the fifth top side 106, and the sixth top side 107 form an interior 109 of the invention 100. The interior 109 is adapted to store a fluid 200 therein. The fluid 200 may be a hydrocarbon fuel, which is commonly dispensed from gas cans.

The first side 102 includes a level window 110 that is vertically oriented, and which provides a clear indication as to the volume of the fluid 200 contained in the interior 109 of the invention 100. The level window 110 extends upwardly along a majority of a height 111 of the invention 100. The height 111 being the distance between the top edge 108 and the base portion 101. The first side 102, the second side 103, and the third side 104 may include a reflective decal 112 thereon.

The invention 100 includes a contoured handle 113 that is located along a rear and bottom portion of the invention 100. The contoured handle 113 is essentially an opening that extends from the second surface 103 downwardly as well as inwardly to a bottom surface 114 of the base portion 101. The contoured handle 113 has a handle width 115 that is adapted to receive a plurality of fingers 301 of a hand 300 therein. The contoured handle 113 curves inwardly as well as downwardly, and around a glove compartment 116 that is integrated into the base portion 101.

The glove compartment 116 extends across a base width 117 of the base portion 101. The glove compartment 116 enables at least one glove 118 to be stored therein, and used in connection with the hand 300 when dispensing the fluid 200 from the invention 100. The glove compartment 116 includes a plug 119 to seal off the glove compartment 116. As a side note, the base portion 101 may flange outwardly with respect to the first side 102, the second side 103, the third side 104, and the fifth side 105. Moreover, the base portion 101 may flange outwardly in order to increase a footprint of the invention 100.

A spout 120 extends from the sixth top side 107. A molded handle 121 is provided on the fifth top side 106. The spout 120 is in fluid communication with the interior 109 of the invention 100 in order to dispense the fluid 200 there from. The spout 120 may include a threaded connector 129 that enables the spout 120 to be removed in order to refill the invention 100 as needed. The spout 120 may include a bend 130 to improve dispensing the fluid 200 from the spout 120.

The molded handle 121 includes a handhold 122 thereon as well as a clip hole 123 and a bungi cord hole 124. The handhold 122 is adapted to be grasped via the hand 300. The clip hole 123 enables one of a plurality of identifying tags 125 to be clipped thereto. The plurality of identifying tags 125 are used to indicate the type of fluid 200 contained within the invention 100. The fifth top side 106 also includes a vent 126 to aid in dispensing vapor build up inside of the invention 100, and is well known in the art of gas cans. The vent 126 is in fluid communication with the interior 109 of the invention 100.

It shall be noted that the invention 100 is to be manipulated via both the handhold 122 of the molded handle 121 and the contoured handle 113. Moreover, the handhold 122 is opposite of the contoured handle 113. The spout 120 is able to dispense the fluid 200 into a vessel 500.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A gas can comprising:

a base portion from which a first side, a second side, a third side, and a fourth side extend vertically;

a fifth top side and a sixth top side attached atop of the first side, the second side, the third side, and the fourth side;

wherein the fifth top side and the sixth top side enclose an interior of said gas can;

a spout to dispense a fluid from said interior;

wherein a contoured handle is provided on the base portion and the second side in order to provide a place with which to manually grasp the gas can;

wherein the first side is opposite the third side;

wherein the second side is opposite the fourth side;

wherein the fifth top side is adjacent the first side, the second side, and the third side;

wherein the sixth top side is adjacent the third side, the fourth side, and the first side;

wherein the sixth top side abuts the fifth top side at a top edge;

wherein the fifth top side and the sixth top side are obtusely oriented with respect to one another;

wherein the first side includes a level window that is vertically oriented, and which provides a clear indication as to the volume of the fluid contained in the interior;

wherein the level window extends upwardly along a majority of a height of the first side; wherein the height is the distance between the top edge and the base portion;

wherein the first side, the second side, and the third side include a reflective decal thereon;

wherein the contoured handle is located along a rear and bottom portion of the gas can;

wherein the contoured handle is an opening that extends from the second side downwardly as well as inwardly to a bottom surface of the base portion;

wherein the contoured handle has a handle width that is adapted to receive a plurality of fingers of a hand therein;

wherein the contoured handle curves inwardly as well as downwardly, and around a compartment that is integrated into the base portion;

wherein the compartment extends across a base width of the base portion.

2. The gas can according to claim 1 wherein the compartment is configured to store at least one glove therein, and used in connection with the hand when dispensing the fluid from the gas can.

3. The gas can according to claim 2, further comprising a plug to seal off the compartment.

4. The gas can according to claim 3 wherein the base portion flanges outwardly with respect to the first side, the second side, the third side, and the fourth side; wherein the base portion flanges outwardly in order to increase a footprint of the gas can.

5. The gas can according to claim 4 wherein the spout extends from the sixth top side; wherein the spout includes a bend to aid dispensing the fluid from the spout; wherein the spout is in fluid communication with the interior of the gas can in order to dispense the fluid there from; wherein the spout includes a threaded connector such that the spout is removed in order to refill the gas can as needed.

6. The gas can according to claim 5 wherein a molded handle is provided on the fifth top side.

7. The gas can according to claim 6 wherein the molded handle includes a handhold thereon as well as a clip hole and a bungi cord hole; wherein the handhold is adapted to be grasped via the hand; wherein the gas can is manipulated via both the handhold of the molded handle and the contoured handle; wherein the handhold is opposite of the contoured handle.

8. The gas can according to claim 7 wherein the clip hole enables one of a plurality of identifying tags to be clipped thereto; wherein the plurality of identifying tags indicate the type of fluid contained within the gas can.

9. The gas can according to claim 8 wherein the fifth top side includes a vent to aid in dispensing vapor build up inside of the gas can; wherein the vent is in fluid communication with the interior of the gas can.

* * * * *